US008771021B2

(12) United States Patent
Edeler

(10) Patent No.: US 8,771,021 B2
(45) Date of Patent: Jul. 8, 2014

(54) AUDIO JACK WITH ESD PROTECTION

(75) Inventor: Wolfgang Edeler, Vreden (DE)

(73) Assignee: BlackBerry Limited, Waterloo (CA)

( * ) Notice: Subject to any disclaimer, the term of this patent is extended or adjusted under 35 U.S.C. 154(b) by 540 days.

(21) Appl. No.: 12/910,278

(22) Filed: Oct. 22, 2010

(65) Prior Publication Data

US 2012/0099742 A1 Apr. 26, 2012

(51) Int. Cl.
*H01R 24/04* (2006.01)

(52) U.S. Cl.
USPC ..... 439/668

(58) Field of Classification Search
USPC ..... 439/668, 669, 188, 181; 200/51.09
See application file for complete search history.

(56) References Cited

U.S. PATENT DOCUMENTS

| | | | | |
|---|---|---|---|---|
| 4,393,283 | A * | 7/1983 | Masuda | 200/51.09 |
| 4,659,167 | A | 4/1987 | Masuda | |
| 5,266,042 | A | 11/1993 | Hampel | |
| 5,277,628 | A * | 1/1994 | Lin et al. | 439/668 |
| 5,522,738 | A * | 6/1996 | Lace | 439/669 |
| 6,062,885 | A * | 5/2000 | White | 439/188 |
| 6,224,408 | B1 * | 5/2001 | Wu | 439/188 |
| 6,439,932 | B1 * | 8/2002 | Ripolone | 439/668 |
| 6,461,199 | B1 * | 10/2002 | Koga et al. | 439/668 |
| 6,676,423 | B1 | 1/2004 | Marowsky et al. | |
| 6,808,404 | B1 * | 10/2004 | Doyle et al. | 439/188 |
| 7,150,641 | B2 * | 12/2006 | Tsai | 439/188 |
| 7,241,179 | B2 * | 7/2007 | Chennakeshu | 439/668 |
| 7,247,037 | B2 * | 7/2007 | Smadi et al. | 439/181 |
| 7,407,416 | B1 * | 8/2008 | Rogers et al. | 439/669 |
| 7,648,400 | B2 * | 1/2010 | Zhu et al. | 439/668 |
| 7,988,498 | B1 * | 8/2011 | Lim et al. | 439/669 |
| 8,014,533 | B2 * | 9/2011 | Felder | 381/17 |
| 8,348,684 | B2 * | 1/2013 | Ladouceur et al. | 439/131 |
| 8,362,654 | B2 * | 1/2013 | Inha et al. | 307/112 |
| 2002/0151201 | A1 * | 10/2002 | Bohbot | 439/188 |
| 2004/0242076 | A1 * | 12/2004 | Nakai et al. | 439/668 |
| 2008/0305676 | A1 | 12/2008 | Fiennes | |
| 2010/0215183 | A1 * | 8/2010 | Hansson et al. | 381/58 |
| 2012/0099742 | A1 * | 4/2012 | Edeler | 381/120 |
| 2012/0144072 | A1 * | 6/2012 | Hansson et al. | 710/15 |

FOREIGN PATENT DOCUMENTS

| | | |
|---|---|---|
| EP | 1835574 A2 | 9/2007 |
| EP | 2224748 A1 | 9/2010 |

OTHER PUBLICATIONS

Extended European Search Report dated Mar. 29, 2011. In corresponding application No. 10188508.5.
Office Action mailed Dec. 12, 2012, in corresponding Canadian patent application No. 2,753,084.
Non-Final Office Action mailed Nov. 22, 2013, in corresponding U.S. Appl. No. 14/056,799.

(Continued)

*Primary Examiner* — Alexander Gilman
(74) *Attorney, Agent, or Firm* — Novak Druce Connolly Bove + Quigg LLP

(57) ABSTRACT

A plug-and-jack for use with an electronic device that is configured to ensure circuitry of the device is protected from electrostatic discharge. In one case, the jack is an audio jack designed to protect high gain circuitry of the device against electrostatic discharge from the leads of an audio plug. The jack includes a mechanical switch that only connects the high gain circuitry to the appropriate portion of the audio plug once the audio plug is fully inserted. At the same time, the mechanical switch also connects the high gain circuitry and corresponding portion of the audio plug to an electrostatic discharge circuit.

17 Claims, 5 Drawing Sheets

(56) References Cited

OTHER PUBLICATIONS

Examination Report mailed Sep. 9, 2013, in corresponding European patent application No. 10188508.5.

* cited by examiner

AUDIO JACK WITH ESD PROTECTION

TECHNICAL FIELD

The present application relates to electrical connectors for electronic devices. More specifically, the application discloses an apparatus for protecting electronic components from electrostatic discharge from electrical connectors.

BACKGROUND

Electronic devices often have electrical inputs and outputs carried over connectable cables. These cables are often connected to the internal circuitry of the devices via plug-and-jack arrangements. However, any time a plug from an external cable is connected electrically to the internal circuitry of an electronic device, it carries with it the risk of damaging the device through the discharge of any electrostatic charge carried by the cable.

Accordingly, efforts have been made to incorporate protection against electrostatic discharge (ESD) into the electrical connector jacks of electronic devices. Some devices design their jacks to ensure that any plug being inserted comes into contact with a grounded contact before it comes into contact with the internal circuitry of the device. However, momentary contact with a simple ground wire may not completely discharge the electrostatic charge of an external cable, and even small electrostatic charges have the capability to damage highly sensitive internal components. Furthermore, electrostatic charge may continue to build up on some connected devices or cables after a plug is inserted, and after the external cable has been momentarily grounded by contact with the ground wire of the jack.

Thus, there exists a need for an electronic device or a jack within an electronic device that addresses, in part, these concerns.

DETAILED DESCRIPTION OF EXEMPLARY EMBODIMENTS

Figure 1:
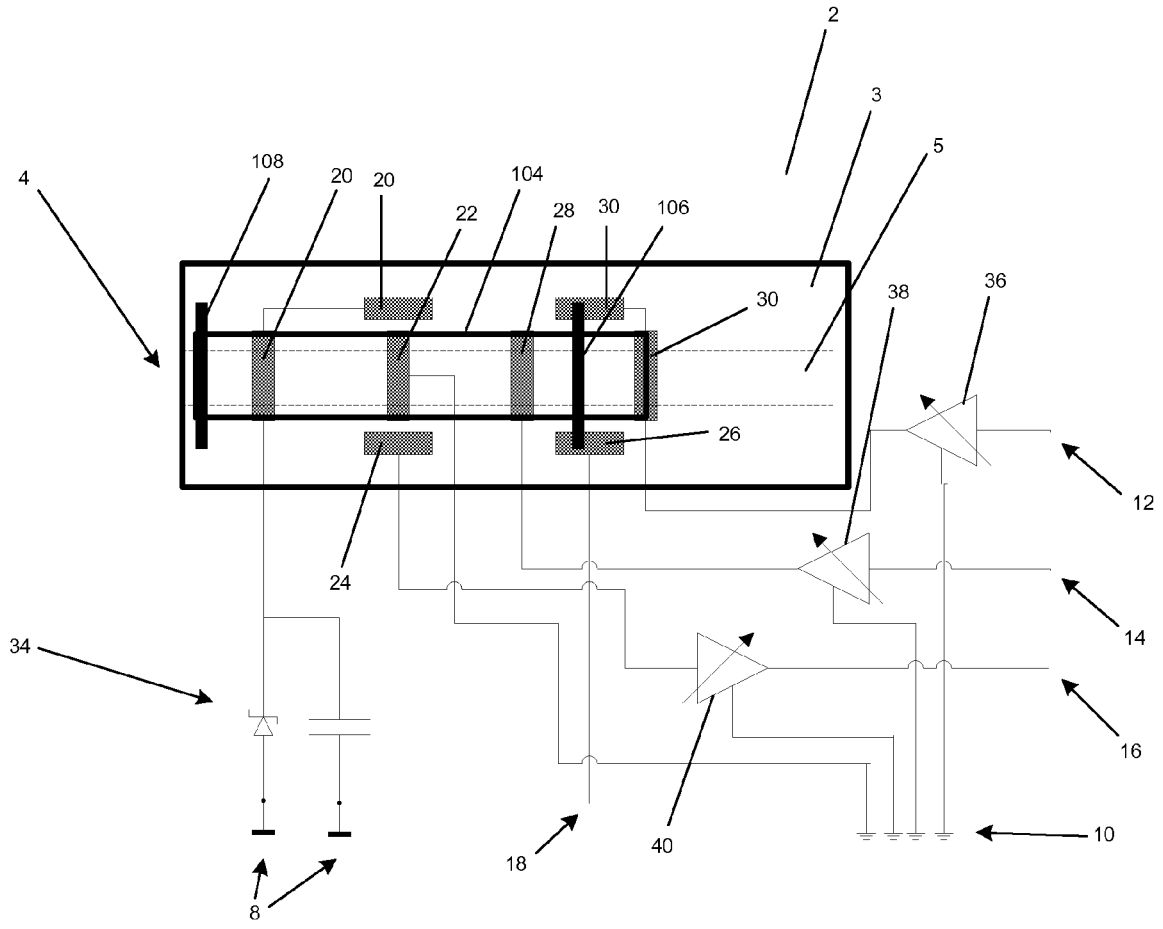
FIG. 1 is a cross-sectional view and circuit diagram of an exemplary audio jack with ESD protection, showing the relation of various jack components to the internal circuitry of an electronic device.

The present application describes a jack within an electronic device that is configured to ensure circuitry of the device is protected from electrostatic discharge. In at least one embodiment, the jack is an audio jack designed to protect the circuitry of the device against electrostatic discharge from the leads of an audio plug.

In a first aspect, the present application describes an electronic device, comprising an audio jack for receiving insertion of an audio plug, the audio plug having two or more plug contacts, each plug contact being separated from the other plug contacts by at least one insulating ring, wherein one of the plug contacts provides an audio signal; an audio subsystem for processing signals, the audio subsystem including a high gain circuit for amplifying the audio signal; and an electrostatic discharge circuit, wherein the audio jack includes an enclosure defining an elongate cavity having an opening at one end, a first jack contact positioned within the cavity, proximate to the opening and connected to the electrostatic discharge circuit, a second jack contact within the cavity disposed further from the opening than the first jack contact so as to contact the plug contact providing the audio signal when the audio plug is fully inserted; and a mechanical switch having an open position and a closed position, wherein the mechanical switch is biased in the open position and wherein the mechanical switch is configured to be moved into the closed position as a result of full insertion of the audio plug, and wherein in the closed position the mechanical switch electrically connects the first jack contact to the second jack contact and electrically connects the second jack contact to the high gain circuit.

In another aspect, the present application further includes a microphone jack contact within the enclosure but not positioned to directly contact the audio plug, the microphone jack contact is connected to the high gain circuit, and in the closed position the mechanical switch connects the second jack contact to the microphone jack contact.

In a further aspect, the electronic device includes a signal ground, and the second jack contact comprises an audio signal jack contact connected to the signal ground.

In a further aspect, the electronic device further includes at least one other jack contact within the cavity disposed further from the opening than the second jack contact, and the at least one other jack contact is connected to the audio subsystem for receiving audio signals for communication to the audio plug.

In a further aspect, the mechanical switch comprises a sled, and in the first position the sled is closer to the opening than in the second position.

In a further aspect, the cavity has a longitudinal axis and the sled moves between the first position and the second position in the direction of the longitudinal axis.

In a further aspect, the sled includes a sled contact, and the sled contact is positioned to electrically connect the first jack contact, the second jack contact, and the high gain circuit when the sled is in the second position.

In a further aspect, the sled contact disconnects from the first jack contact, the second jack contact and the high gain circuit in the first position.

In a further aspect, the audio plug comprises a tip-ring-ring-sleeve plug, and when fully inserted, the first jack contact is positioned to connect with the sleeve of the plug and the second jack contact is positioned to connect with one of the rings of the plug.

In a further aspect, the electronic device comprises a handheld mobile device.

In a further aspect, the application describes an audio jack for receiving insertion of an audio plug, the audio plug having two or more plug contacts, each plug contact being separated from the other plug contacts by at least one insulating ring, wherein one of the plug contacts provides an audio signal, the audio jack being configured for use in an electronic device having a high gain circuit for amplifying the audio signal and having an electrostatic discharge circuit, the audio jack comprising: an enclosure defining an elongate cavity having an opening at one end; a first jack contact positioned within the cavity proximate to the opening and adapted for connection to the electrostatic discharge circuit; a second jack contact within the cavity disposed further from the opening than the first jack contact so as to contact the plug contact providing the audio signal when the audio plug is fully inserted; and a mechanical switch having an open position and a closed position, wherein the mechanical switch is biased in the open position and wherein the mechanical switch is configured to be moved into the closed position as a result of full insertion of the audio plug, and wherein in the closed position the mechanical switch electrically connects the first jack contact to the second jack contact and electrically connects the second jack contact to a microphone jack contact adapted for connection to the high gain circuit.

In a further aspect, the audio jack further includes a microphone jack contact within the enclosure but not positioned to directly contact the audio plug, wherein the microphone jack contact is adapted for connection to the high gain circuit, and wherein in the closed position the mechanical switch connects the second jack contact to the microphone jack contact.

In a further aspect, the electronic device includes a signal ground, and the second jack contact comprises an audio signal jack contact adapted to be connected to the signal ground.

In a further aspect, the audio jack further includes at least one other jack contact within the cavity disposed further from the opening than the second jack contact, and the at least one other jack contact is adapted to be connected to an audio subsystem within the electronic device for receiving audio signals for communication to the audio plug.

In a further aspect, the mechanical switch comprises a sled, and in the first position the sled is closer to the opening than in the second position.

In a further aspect, the cavity has a longitudinal axis and wherein the sled moves between the first position and the second position in the direction of the longitudinal axis.

In a further aspect, the sled includes a sled contact, and the sled contact is positioned to electrically connect the first jack contact, the second jack contact, and the high gain circuit when the sled is in the second position.

In a further aspect, the sled contact disconnects from the first jack contact, the second jack contact and the high gain circuit in the first position.

In a further aspect, the audio plug comprises a tip-ring-ring-sleeve plug, and wherein, when fully inserted, the first jack contact is positioned to connect with the sleeve of the plug and the second jack contact is positioned to connect with one of the rings of the plug.

Although many of the embodiments detailed herein specifically relate to audio plugs, such as may be used in connection with microphones, earphones, headphones, etc., it will be appreciated that the present application is not limited to audio signals. In some embodiments, the jacks and devices described herein may be used in applications involving non-audio analog or digital signals that may be supplied by an external component, input to the electronic device via a plug-and-jack connector, and amplified within the electronic device. Example signals may include sensor signals or video signals. In one example embodiment, the jack may be part of a gaming console or computer and the plug may carry signals to or from an input device, such as a joystick or other hand-held gaming device. In another example embodiment, the jack may be part of a computer, display screen, or television and the plug may carry signals to or from a camera or device incorporating a camera. Other applications will be understood by those ordinarily skilled in the art in light of the detailed description below.

As used herein, elements may be "connected" physically, electrically, or both. In general, elements are physically connected when they are physically joined or coupled to one another, either directly or through one or more interposed elements. Physically connected elements may be, but are not necessarily required to be, actually touching or in direct contact. In addition, physically connected elements may be physically connected to one another via one or more an interposing physical structures. Physically connected elements need not be connected permanently, but may be connected and disconnected. In general, electrically connected elements have a relationship to one another such that a change in an electrical quality of one affects the other, for example, current flowing through one element affects the current flowing through the other. Electrically connected elements need not touch, and need not be proximate to one another, and may be electrically connected via one or more interposing elements such as a conducting wire, resistor or transformer. As used herein, a statement that two elements are electrically connected should not be deemed to be a statement that the two elements are not physically connected, or vice versa.

In many of the embodiments described herein, the audio plug and corresponding audio jack are of the "TRS connector"-type. In some embodiments, the audio plug may be a three-contact tip-ring-sleeve (TRS) connector. In some other embodiments, the audio plug may be a four-contact tip-ring-ring-sleeve (TRRS) connectors. In yet other embodiments, the audio plug may be a tip-sleeve (TS) connector. It will also be appreciated that although the example embodiments described below relate to cylindrical TRRS or TRS audio plugs, the present application may be embodied in audio plugs and audio jacks having non-cylindrical shapes.

FIG. 1 shows an exemplary embodiment of an audio jack 2 with related ESD circuitry and other circuitry. The jack 2 is adapted to accommodate an audio plug (not shown) having multiple electrical plug contacts for making electrical connections to corresponding jack contacts within the audio jack 2. In this embodiment, the audio plug is a TRRS connector.

The audio jack 2 includes an enclosure 3 defining a cavity 5 shaped to accommodate the TRRS-type audio plug. The enclosure 3 defines an opening 4 at one end of the cavity 5 for insertion of the audio plug. Within the cavity 5, the audio jack 2 includes a first jack contact, referred to hereinafter as an ESD jack contact 20. The ESD jack contact 20 is located proximate to the opening 4 and is at the inner surface of the cavity 5 so as to come into contact with the plug contacts as the audio plug is inserted into the jack 2. (As used herein, "proximate" means "near" or "close to" and in some contexts may mean "adjacent to," and may be used to indicate relative closeness of elements, but does not necessarily indicate any particular measurement or value.) The ESD jack contact 20 is physically and electrically connected to an electrostatic discharge (ESD) circuit 34 capable of harmlessly directing electrostatic discharge from plug contacts to the system ground 8.

The audio jack 2 includes a second jack contact (hereinafter referred to as a signal ground jack contact 22) disposed within the cavity 5 and located further away from the opening 4 than the ESD jack contact 20. The signal ground jack contact 22 is physically and electrically connected to signal ground 10, which represents the audio signal return with respect to outbound audio signals, such as for speakers or earphones.

Also disposed within the inner cavity 5 of the audio jack 2 are a right speaker jack contact 28, and a left speaker jack contact 30. With the audio plug fully inserted in the audio jack 2, the TRRS plug contacts come into alignment with the jack contacts 20, 22, 28, 30, respectively.

The ESD circuit 34 is electrically connected to a system ground 8. In the example embodiment shown in FIG. 1, the ESD circuit includes a zener diode and capacitor in parallel. Other embodiments may use additional or other diodes, including transient voltage suppression (TVS) diodes. In this embodiment, the diode has low parasitic capacitance to avoid attenuating the analog microphone signal. The capacitor may act as a DC ground, dissipating ESD while preserving AC signals. In other embodiments, the ESD circuit may take other forms, and may include multiple diodes and/or multiple capacitors.

The audio jack 2 may be used within an electronic device having a casing (not shown). The casing may also be electrically connected to system ground 8, as may other components or elements of the electronic device.

The audio jack 2 is configured to receive a left speaker signal 12 and a right speaker signal 14. As illustrated in FIG. 1, the left speaker signal 12 and right speaker signal 14 may be amplified by a left speaker amplifier 36 and right speaker amplifier 38, respectively, within the electronic device before reaching the left speaker jack contact 30 and right speaker jack contact 28, respectively.

The audio jack 2 further includes a microphone jack contact 24. The microphone jack contact 24 is not located on the inner surface of the cavity 5 as it is not intended to come into direct physical contact with the audio plug. Rather, in this embodiment, the microphone jack contact 24 is electrically connected to both the signal ground jack contact 22 and the ESD jack contact 20 by way of a switch. The switch is configured to have a first or open position in which the microphone jack contact 24 is electrically disconnected from the signal ground jack contact 22 and from the ESD jack contact 20, and a second or closed position in which the microphone jack contact 24 is brought into circuit with the signal ground jack contact 22 and the ESD jack contact 20. The switch is configured to be biased in the open position and may be actuated or moved into the second position as a result of full insertion of the audio plug.

This configuration results in the microphone jack contact 24 being left out of circuit and unconnected to plug contacts until the audio plug is fully inserted and ready for use. It also results in the microphone jack contact 24 being connected to the ESD jack contact 20 and, as a result, to the ESD circuit 34 once the microphone jack contact 24 is ready for use. This is advantageous since the microphone jack contact 24 is to be connected to a high gain circuit, in this case a microphone amplifier 40, within the electronic device. Because the microphone jack contact 24 is intended to supply audio signals to a high gain circuit, i.e. the microphone amplifier 40, electrostatic discharge events are particularly hazardous to the electronic device if they occur in this portion of the jack 2. Thus, the present configuration results in the ESD circuit 34 being electrically connected to the high gain circuit (microphone amplifier 40) whilst the audio plug is fully inserted.

In this embodiment, the switch is implemented as a sliding sled 104. The sled 104 has a sled microphone-ESD contact 108. The sled 104 is biased in the open position, toward the jack opening 4, using any of a number of biasing elements, such as a spring. When a force is applied the sled 104, such as by insertion of the audio plug, it is configured to slide longitudinally into the jack 2. In its first or open position, the sled microphone-ESD contact 108 is out of circuit. When the sled 104 is pushed into its closed position, as will be explained below, the sled microphone-ESD contact 108 electrically connects the microphone jack contact 24, the signal ground jack contact 22, and the ESD jack contact 20. The sled 104 may configured to slide between the first and second positions by way of one or more longitudinal tracks or grooves (not shown) within the enclosure 3 and corresponding pins or flanges (not shown) on the sled 104 configured to engage their respective tracks or grooves to maintain the sled in place, but permit sliding movement between the first and second positions. Those ordinarily skilled in the art will appreciate there are a number of other mechanical configurations that may be used to implement the sled 104 and enclosure 3 arrangement.

The sled 104 includes a second contact, namely a sled-plug detect contact 106. The jack 2 includes a plug-detect jack contact 26. The plug-detect jack contact 26 is not intended for direct physical contact with the audio plug; rather, it is electrically connected to the left speaker jack contact 30 through the sled-plug detect contact 106 when the sled is in the first or open position. The plug-detect jack contact 26 provides a plug-detect signal 18 to the electronic device. The electronic device may therefore determine whether an audio plug has been inserted in the jack 2, and may take certain actions, for example preventing audio output signals from going to device speakers and instead routing them to the audio jack 2 for output through the audio plug. As will be explained below, once the audio plug is fully inserted in the jack 2 the sled 104 moves such that the sled plug-detect contact 106 disengages from the plug-detect jack contact 26 and the left speaker jack contact 30, thereby taking the plug-detect jack contact 26 out of circuit.

Operation of the audio jack 2 is now further illustrated with reference to FIGS. 2, 3, and 4.

Figure 2:
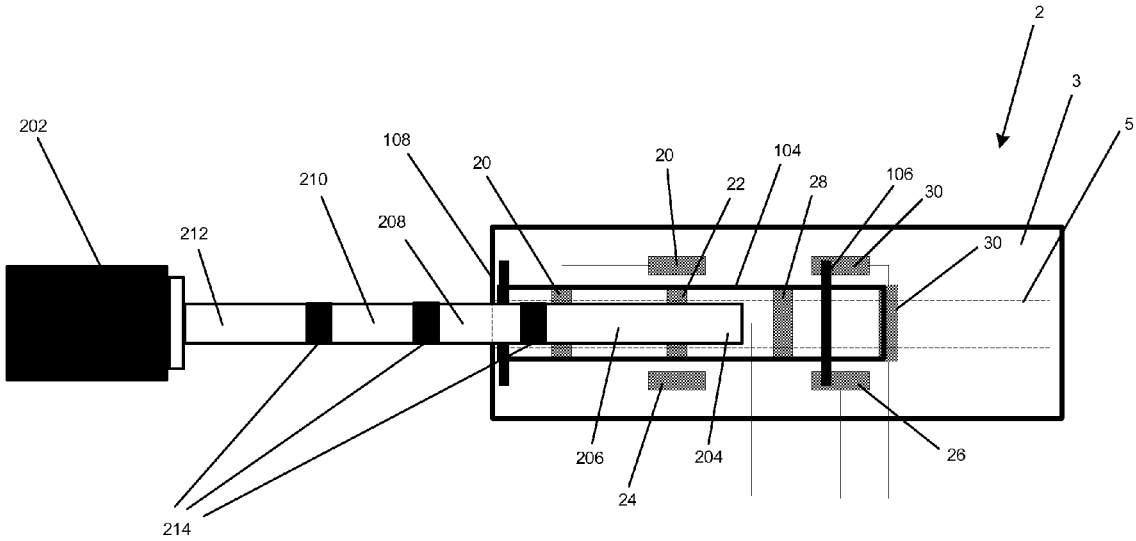
FIG. 2 is a cross-sectional view of the audio jack of FIG. 1 and an exemplary four-contact plug.

FIG. 2 shows an example embodiment of an audio plug 202 partially inserted into the jack 2 of FIG. 1. The plug 202 is a TRRS-type plug, having four plug contacts along its length: an ESD plug contact 212, a microphone plug contact 210, a right speaker plug contact 208, and a left speaker plug contact 206. As the plug tip 204 is inserted into the jack 2, the left speaker plug contact 206 comes into contact with the ESD jack contact 20, allowing any electrostatic charge built upon the left speaker plug contact 206 to discharge through the ESD circuit 34 (FIG. 1). As the audio plug 202 is inserted into the jack 2, each of the plug contacts 206, 208, 210, and 212, comes into contact with the ESD jack contact 20 in turn, allowing static charge to be dissipated through the ESD circuit 34.

Figure 3:
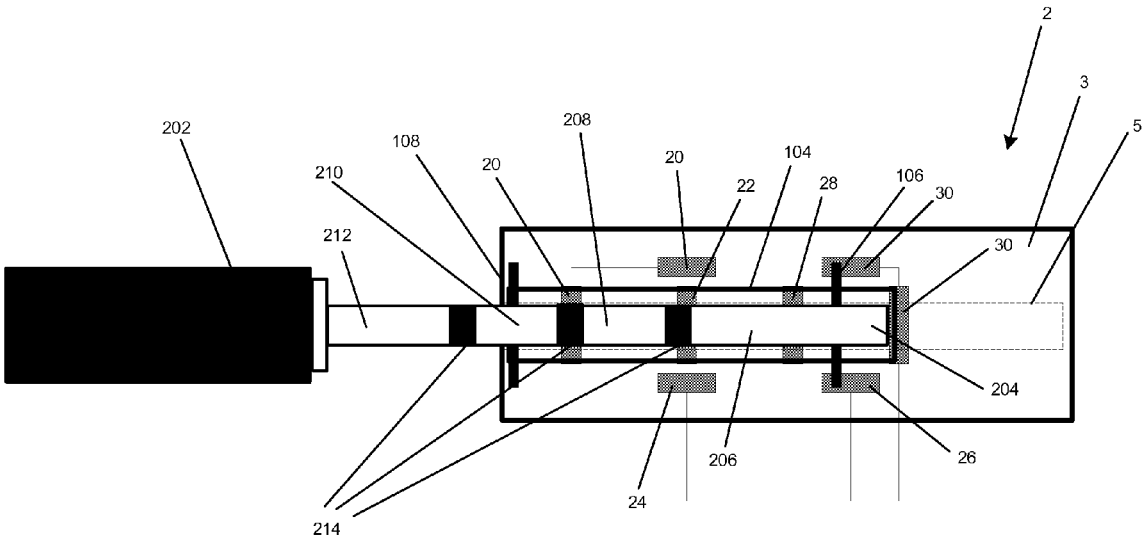
FIG. 3 is a cross-sectional view of the audio jack of FIG. 1-2 and the plug of FIG. 2 partially inserted into the jack.

FIG. 3 shows the plug 202 inserted deeper into the jack 2 than in FIG. 2. Here, the tip of the plug 204 has come into contact with the sled 104. In this embodiment, the sled 104 has an inner end or abutment surface against which the plug tip 204 is intended to bear. As the plug 202 is inserted further into the jack 2, the plug tip 204 will push the sled 104 from its first or open position to its second or closed position. If the plug 202 is withdrawn, a bias mechanism such as a spring or other device causes the sled 104 to return to the first position.

Figure 4:
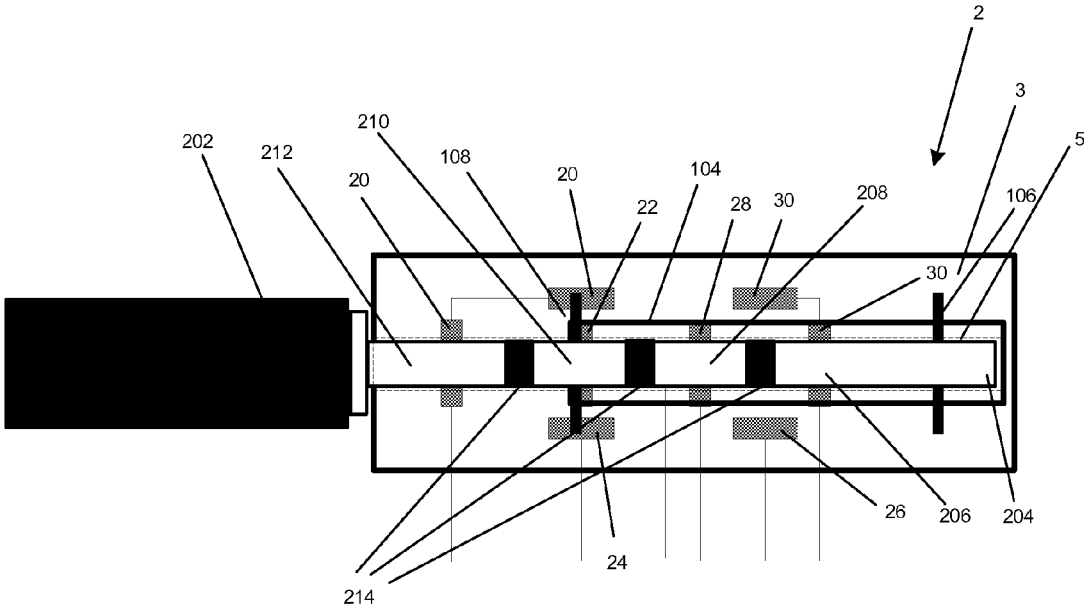
FIG. 4 is a cross-sectional view of the audio jack of FIG. 1-3 and the plug of FIG. 2-3 fully inserted into the jack.

FIG. 4 shows the plug 202 fully inserted into the jack 2 of FIG. 1 to FIG. 3. The sled 104 has been pushed into its second position. This movement of the sled 104 causes corresponding movement of the sled plug-detect contact 106, which disconnects the jack plug-detect contact 26 from the jack left-speaker contact 30. The electronic device detects this disconnection as the plug-detect signal 18, which indicates that the plug is fully or mostly inserted. The movement of the sled 104 to this second position has also closed a circuit between the sled microphone-ESD contact 108, the microphone jack contact 24, the signal ground jack contact 22, and the ESD jack contact 20.

The four plug contacts 206, 208, 210, 212 of the plug 202 are separated by insulating rings 214. As a consequence of the separation and insulation due to the respective insulating rings 214, the plug contacts 206, 208, 210, 212 are not in immediate physical contact with one another and are not electrically connected to one another. Each plug contact is electrically connected to the corresponding wire in the audio cable carrying a signal: the plug left speaker contact 206 is connected to the cable's left speaker wire, the plug right speaker contact 208 is connected to the cable's right speaker wire, and the plug microphone contact 210 is connected to the cable's microphone (or signal ground) wire.

The jack 2 protects the internal electrical components of the system where it is installed by bringing each plug contact surface into contact with the ESD jack contact 20 before that plug contact surface comes into contact with any of the sensitive audio circuitry of the system. Low-gain components, like the speaker amplifier 36, 38 outputs, are usually not highly sensitive to ESD from an external plug. The momentary contact between the speaker plug contacts 206, 208 and the ESD jack contact 20 is likely therefore sufficient to discharge any electrostatic charge built up on these leads. A high-gain component like the microphone amplifier 40 input, on the other hand, may benefit from being more thoroughly protected against ESD due to its higher sensitivity. Thus, the microphone jack contact 24 is brought into circuit with the microphone plug contact 210 when it is simultaneously in circuit with both the ESD jack contact 20 and signal ground jack contact 22, and after the microphone plug contact 210 has had separate contact with the ESD jack contact 20. These protective measures may assist in ensuring that any residual electrostatic charge remaining on the microphone plug contact 210 can be dissipated by the ESD circuit 34 (FIG. 1), along with any charge that builds up on the external microphone in use.

The audio signal ground 10 is distinct from the system ground 8. The audio signal ground 10 is insulated from the system ground 8 and filtered for noise, thereby preventing artifacts from being introduced into the audio signals by ground loops or other interference effects, such as electromagnetic induction (EMI) effects.

In the TRRS plug configuration described above, the sleeve, corresponding here to the ESD plug contact 212, serves to ground the plug 202. However, it will be appreciated that, because the microphone plug contact 210 is electrically connected with the ESD plug contact 212 when the plug is inserted, the microphone plug contact 210 and the ESD plug contact 212 may be interchangeable for some applications. Thus, their positions can be switched in some embodiments, with the sleeve being used to carry microphone signals.

Figure 5:
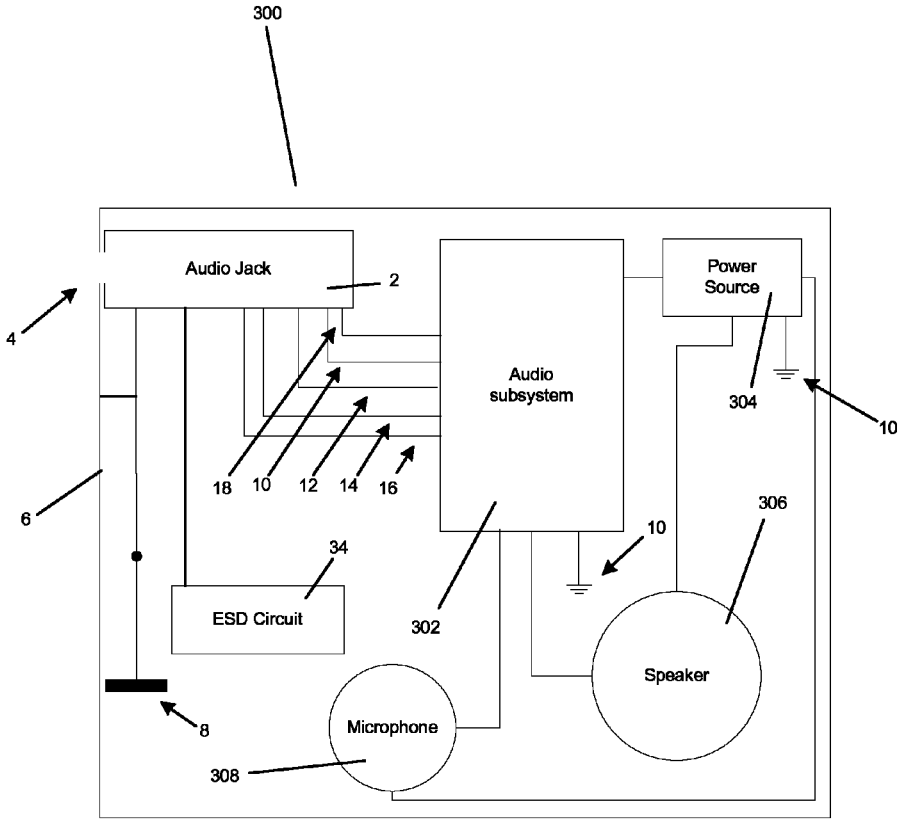
FIG. 5 is a block diagram of an exemplary electronic device incorporating the audio jack of FIG. 1.

FIG. 5 shows one example of an electronic device 300 having an audio jack 2 as described above. The device 300 is enclosed in a case 6. The audio jack 2 is arranged such that the opening 4 registers with a corresponding opening in the case 6 permitting insertion of an audio plug into the jack 2. The system ground 8 of the device 300 connects to the ESD circuit 34. In some embodiments, the case 6 may also be grounded.

The electronic device 300 includes an audio subsystem 302 and a power source 304. The audio subsystem 302 is typically a tangible component that may comprise for example circuitry and a processor configured to process audio signals. The audio subsystem 302 generates speaker signals 12, 14 and receives microphone signal 16. The audio subsystem 302 is connected to the audio signal ground 10.

In this embodiment, the device 300 also includes a built-in speaker 306 and microphone 308, which may be used by the audio subsystem 302 as an alternative or in addition to any external microphones, earpieces, or speakers plugged into the jack 2. The audio subsystem 302 receives the plug-detect signal 18 from the audio jack 2. The power source 304 provides power to the speaker 306, microphone 308, and audio subsystem 302. The power source 304 is also connected to the signal ground 10.

When no plug is inserted into the jack 2, the plug-detect signal 18 is equivalent to the output of the left speaker amplifier 36. This signal can indicate to the device 300 that the user is not using an earpiece or other external speaker and/or microphone, which may change the behavior of one or more operations of the device 300. For example, the plug-detect signal 18 can be propagated to the built-in speaker 306 of the device 300, or a phone-call application of the device 300 may employ the built-in speaker 306 and microphone 308 for telephone communications instead of using an external microphone and earpiece unit. However, when the plug 202 (FIG. 2) is inserted into the jack 2, the device 300 may switch to using the plugged-in external microphone, speakers, and/or earpiece instead of any built-in microphone 308 or speaker 306 components.

In some embodiments, the device 300 is a mobile electronic device having a processor, a memory, a rigid plastic case, a visual display, and user input devices, such as a keyboard, trackball, scrollwheel, and/or touchscreen. The processor may execute various software applications stored in memory, such as a phone application, a media application, a gaming application or others. The operations of these applications may be affected by the state of the plug-detect signal 18: for example, a phone application may switch between using the external microphone and earpiece and the built-in microphone 308 and speaker 306 during a phone call depending on the state of the plug-detect signal 18. Alternatively, the device 300 may have configuration settings allowing a user to set the behavior of one or more applications of the device 300 depending on the state of the plug-detect signal 18.

Referring again to FIGS. 1-4, the contacts of the jack 2 and plug 202 may be embodied as smooth conductive surfaces. Those contacts that come directly into contact with each other, such as the plug left speaker contact 206 and the jack left speaker contact 30, are in some embodiments shaped as complementary surfaces. Other contacts that are only brought into circuit through the action of the mechanical switch, such as the microphone jack contact 24 in the above-described embodiments, may have a different shape. Those skilled in the art will be aware of the range of variations in implementing plug-and-socket connections.

In an exemplary embodiment, the plug 202 comprises a 2.5 mm-diameter, four-contact TRRS connector. Alternatively, it may comprise a three-contact TRS connector or any other plug type with one or more contacts.

The arrangement of the various contacts within the jack 2 and along the length of the plug 202 may differ from the above-described configuration in certain embodiments. The sled 104 (or a different embodiment of a mechanical switch) might operate to bring more than one signal contact of the jack 2 into circuit with the ESD circuit 34 once the plug 202 is inserted. Furthermore, the jack contacts positioned furthest from the opening 4 need not be speaker contacts; in some embodiments, these contacts could be connected to other components of the electrical device 300, and the jack 2 could have two or more of them, only one, or none. The ESD jack contact 20 and/or the signal ground jack contact 22 in some embodiments may not be placed along the inside surface of the cavity 5.

The jack 2 and/or plug 202 may be further adapted to retain the plug 202 in the jack 2 when fully inserted. For example, the plug 202 may have a groove around its circumference near the plug tip 204, and the inside of the jack 2 may have one or more complementary flexible protrusions adapted to fit into the groove and retain the plug 202 when it is fully inserted. Alternatively or in addition, the jack 2 and sled 104 may be adapted to lock the sled 104 into position when the plug 202 is fully inserted, so as to prevent the spring bias of the sled 104 from forcing the plug 202 back out of the jack 2. The means by which the sled 104 could be held in place could comprise any of a number of releasable mechanisms known in the art, including any of a number of different latches, catches, gears, or teeth.

Although the embodiments detailed above implement the mechanical switch as a sliding sled 104, any of a number of alternative embodiments are possible. Other types of mechanical switches could be used to affect the same functions as the sled 104 detailed above, namely opening and closing one or more circuits as the plug 202 is inserted. For example, the switch could operate by rotational or radial motion in response to the insertion of the plug 202, rather than the longitudinal sliding motion of the sled 104.

Some embodiments of the present application may realize one or more benefits, including, but not limited to, reducing the risk of ESD, improving adaptability to a variety of plugs and jacks (beyond audio plugs/jacks), saving manufacturing cost and/or space on a circuit board, among others.

The various embodiments presented above are merely examples and are in no way meant to limit the scope of this disclosure. Variations of the innovations described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. An electronic device, comprising:

an audio jack for receiving insertion of an audio plug, the audio plug having two or more plug contacts, each plug contact being separated from the other plug contacts by at least one insulating ring, wherein one of the plug contacts provides an audio signal;

an audio subsystem for processing signals, the audio subsystem including a high gain circuit for amplifying the audio signal; and an electrostatic discharge circuit, wherein the audio jack includes an enclosure defining an elongate cavity having an opening at one end, a first jack contact positioned within the cavity, proximate to the opening and connected to the electrostatic discharge circuit, a second jack contact within the cavity disposed further from the opening than the first jack contact so as to contact the plug contact providing the audio signal when the audio plug is fully inserted; and a mechanical switch having an open position and a closed position, wherein the mechanical switch is biased in the open position and wherein the mechanical switch is configured to be moved into the closed position as a result of full insertion of the audio plug, and wherein in the closed position the mechanical switch electrically connects the first jack contact to the second jack contact and electrically connects the second jack contact to the high gain circuit, wherein the mechanical switch comprises a sled with contacts on its ends, and wherein in a first position the sled is closer to the opening than in a second position.

2. The electronic device claimed in claim 1, further including a microphone jack contact within the enclosure but not positioned to directly contact the audio plug, wherein the microphone jack contact is connected to the high gain circuit, and wherein in the closed position the mechanical switch connects the second jack contact to the microphone jack contact.

3. The electronic device claimed in claim 2, wherein the electronic device includes a signal ground insulated from a system ground, and wherein the second jack contact comprises an audio signal jack contact electrically connected to the signal ground.

4. The electronic device claimed in claim 3, further including at least one other jack contact within the cavity disposed further from the opening than the second jack contact, and wherein the at least one other jack contact is connected to the audio subsystem for receiving audio signals for communication to the audio plug.

5. The electronic device claimed in claim 1, wherein the cavity has a longitudinal axis and wherein the sled moves between the first position and the second position in the direction of the longitudinal axis.

6. The electronic device claimed in claim 5, wherein the sled contacts include a first contact, and wherein the first sled contact is positioned to electrically connect the first jack contact, the second jack contact, and the high gain circuit when the sled is in the second position.

7. The electronic device claimed in claim 6, wherein the first sled contact disconnects from the first jack contact, the second jack contact and the high gain circuit in the first position.

8. The electronic device claimed in claim 1, wherein the audio plug comprises a tip-ring-ring-sleeve plug, and wherein, when fully inserted, the first jack contact is positioned to connect with the sleeve of the plug and the second jack contact is positioned to connect with one of the rings of the plug.

9. The electronic device claimed in claim 1, wherein the electronic device comprises a handheld mobile device.

10. An audio jack for receiving insertion of an audio plug, the audio plug having two or more plug contacts, each plug contact being separated from the other plug contacts by at least one insulating ring, wherein one of the plug contacts provides an audio signal, the audio jack being configured for use in an electronic device having a high gain circuit for amplifying the audio signal and having an electrostatic discharge circuit, the audio jack comprising:

an enclosure defining an elongate cavity having an opening at one end;

a first jack contact positioned within the cavity proximate to the opening and adapted for electrical connection to the electrostatic discharge circuit;

a second jack contact within the cavity disposed further from the opening than the first jack contact so as to contact the plug contact providing the audio signal when the audio plug is fully inserted; and a mechanical switch having an open position and a closed position, wherein the mechanical switch is biased in the open position and wherein the mechanical switch is configured to be moved into the closed position as a result of full insertion of the audio plug, and wherein in the closed position the mechanical switch electrically connects the first jack contact to the second jack contact and electrically connects the second jack contact to a microphone jack contact adapted for electrical connection to the high gain circuit, wherein the mechanical switch comprises a sled with contacts on its ends, and wherein in a first position the sled is closer to the opening than in a second position.

11. The audio jack of claim 10, wherein the microphone jack contact is positioned within the enclosure but not positioned to directly contact the audio plug, wherein in the closed position the mechanical switch electrically connects the second jack contact to the microphone jack contact.

12. The audio jack claimed in claim 11, wherein the electronic device includes a signal ground insulated from a system ground, and wherein the second jack contact comprises an audio signal jack contact adapted to be electrically connected to the signal ground.

13. The audio jack claimed in claim 12, further including at least one other jack contact within the cavity disposed further from the opening than the second jack contact, and wherein the at least one other jack contact is adapted to be connected to an audio subsystem within the electronic device for receiving audio signals for communication to the audio plug.

14. The audio jack claimed in claim 10, wherein the cavity has a longitudinal axis and wherein the sled moves between the first position and the second position in the direction of the longitudinal axis.

15. The audio jack claimed in claim 14, wherein the sled contacts include a first contact, and wherein the first sled contact is positioned to electrically connect the first jack contact, the second jack contact, and the high gain circuit when the sled is in the second position.

16. The audio jack claimed in claim 15, wherein the first sled contact disconnects from the first jack contact, the second jack contact and the high gain circuit in the first position.

17. The audio jack claimed in claim 10, wherein the audio plug comprises a tip-ring-ring-sleeve plug, and wherein, when fully inserted, the first jack contact is positioned to connect with the sleeve of the plug and the second jack contact is positioned to connect with one of the rings of the plug.

* * * * *